US010517399B2

(12) United States Patent
Harguth et al.

(10) Patent No.: US 10,517,399 B2
(45) Date of Patent: Dec. 31, 2019

(54) ACTIVE SEATING

(71) Applicant: The Prophet Corporation, Owatonna, MN (US)

(72) Inventors: Alison Marie Harguth, Owatonna, MN (US); Ryan William Rasell, Apple Valley, MN (US)

(73) Assignee: The Prophet Corporation, Owatonna, MN (US)

( * ) Notice: Subject to any disclaimer, the term of this patent is extended or adjusted under 35 U.S.C. 154(b) by 77 days.

(21) Appl. No.: 15/721,391

(22) Filed: Sep. 29, 2017

(65) Prior Publication Data

US 2019/0098998 A1 Apr. 4, 2019

(51) Int. Cl.

| | |
|---|---|
| ***A47C 3/04*** | (2006.01) |
| ***A47C 3/029*** | (2006.01) |
| ***A47C 9/00*** | (2006.01) |
| *A47C 3/16* | (2006.01) |

(52) U.S. Cl.

CPC ..... *A47C 3/029* (2013.01); *A47C 3/04* (2013.01); *A47C 9/00* (2013.01); *A47C 3/16* (2013.01)

(58) Field of Classification Search

CPC .. A47C 3/029; A47C 3/04; A47C 3/16; A47C 9/00

USPC ..... 297/239, 271.5, 271.1

See application file for complete search history.

(56) References Cited

U.S. PATENT DOCUMENTS

| | | | | |
|---|---|---|---|---|
| D198,679 | S | 7/1964 | Cartner | |
| 3,563,605 | A * | 2/1971 | Pinkas | A47C 16/025 297/423.42 |
| 3,604,749 | A * | 9/1971 | Parmett | A47C 3/04 297/239 |
| D228,095 | S | 8/1973 | Schmitt | |
| D232,499 | S | 8/1974 | Martinelli | |
| D232,504 | S | 8/1974 | Archinal | |
| D234,933 | S | 4/1975 | Burke | |
| 5,226,865 | A * | 7/1993 | Chin | A63B 23/0458 108/144.11 |
| D498,067 | S | 11/2004 | Van Dyke | |
| D586,574 | S | 2/2009 | Gomree | |
| D625,931 | S | 10/2010 | Estrup | |
| D647,313 | S | 10/2011 | Chen | |
| D650,184 | S | 12/2011 | Hsu | |
| D671,757 | S | 12/2012 | Walker et al. | |
| D728,951 | S | 5/2015 | Yoshida | |
| 9,167,899 | B2 * | 10/2015 | Jackson | A47C 3/029 |
| D767,290 | S | 9/2016 | Walser | |
| D791,523 | S | 7/2017 | Bernard | |

(Continued)

FOREIGN PATENT DOCUMENTS

| | | | | |
|---|---|---|---|---|
| JP | 08112155 A * | 5/1996 | | A47C 7/00 |

OTHER PUBLICATIONS

Plastic Round Stools, Retrieved May 2, 2018 from URL: <http://www.umaplastics.com/plastic-round-stools.html>, 5 pages.

(Continued)

*Primary Examiner* — Syed A Islam

(74) *Attorney, Agent, or Firm* — Merchant & Gould P.C.

(57) ABSTRACT

Stackable stools include rocking surfaces along which the stools can be rocked to allow a user to sway to and fro. The stools have rest surfaces that provide stable inclined positions of the stools. The stools can be stacked together to save space. The stools define holes allowing the stools to be stacked on a pole.

20 Claims, 13 Drawing Sheets

(56) References Cited

U.S. PATENT DOCUMENTS

| | | | | |
|---|---|---|---|---|
| D809,309 | S | 2/2018 | Theesfeld | |
| D809,310 | S | 2/2018 | Mathur et al. | |
| D809,809 | S | 2/2018 | Theesfeld et al. | |
| D812,919 | S | 3/2018 | Kim | |
| 2010/0066139 | A1* | 3/2010 | Woodring | A47C 3/029 297/239 |

OTHER PUBLICATIONS

Thick plastic small round stools, home adult children bathroom stool, changing his shoes stool, Retrieved May 2, 2018 from URL: <https://www.aliexpress.com/item/Thick-plastic-small-round-stools-home-adult-children-bathroom-stool-changing-his-shoes-stool/32507580751.html, 17 pages.

TiltED Active Seats, Retrieved May 2, 2018 from URL: https://www.gophersport.com/pe/active-classroom/tilted-active-seats?item=25259&pt_source=googleads&pt_med i um =cpc&pt_campaign=Shopping_-_%E2%80%A6, 2 pages.

Play with a Purpose Catalog; Spring 2017; © 2017 Gopher Sport; 4 pages.

* cited by examiner

ACTIVE SEATING

BACKGROUND

Active seating allows a user freedom of movement while remaining seated. For example, a user may be able to pivot, rotate, or otherwise move the seat while sitting in the seat. Other seating includes pedals or other structures that can be moved by the user while the user remains seated. Such active seating can be cumbersome to move and/or store. Improvements are desired.

SUMMARY

In accordance with some aspects of the disclosure, a stool includes a seat member; a first support member; and a second support member. Each support member defines a downwardly-facing surface having a convexly-curved rocking surface. In certain examples, the support members also define rest surfaces.

In certain implementations, each support member defines a rest surface at each side of the rocking surface. Each rest surface inhibits movement of the stool beyond the rest surface.

In certain implementations, multiple stools can be stacked together. Each stool has a closed top and an open bottom. The top of the stool has a smaller cross-dimension than the bottom. Each stool is sufficiently hollow to allow a first of the stools to be stacked over a second of the stools so that the top of the second stool extends into the hollow interior of the first stool through the open bottom of the first stool. In certain implementations, each of the stools defining a rocking surface at the respective open bottom.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

DETAILED DESCRIPTION

Figure 1:
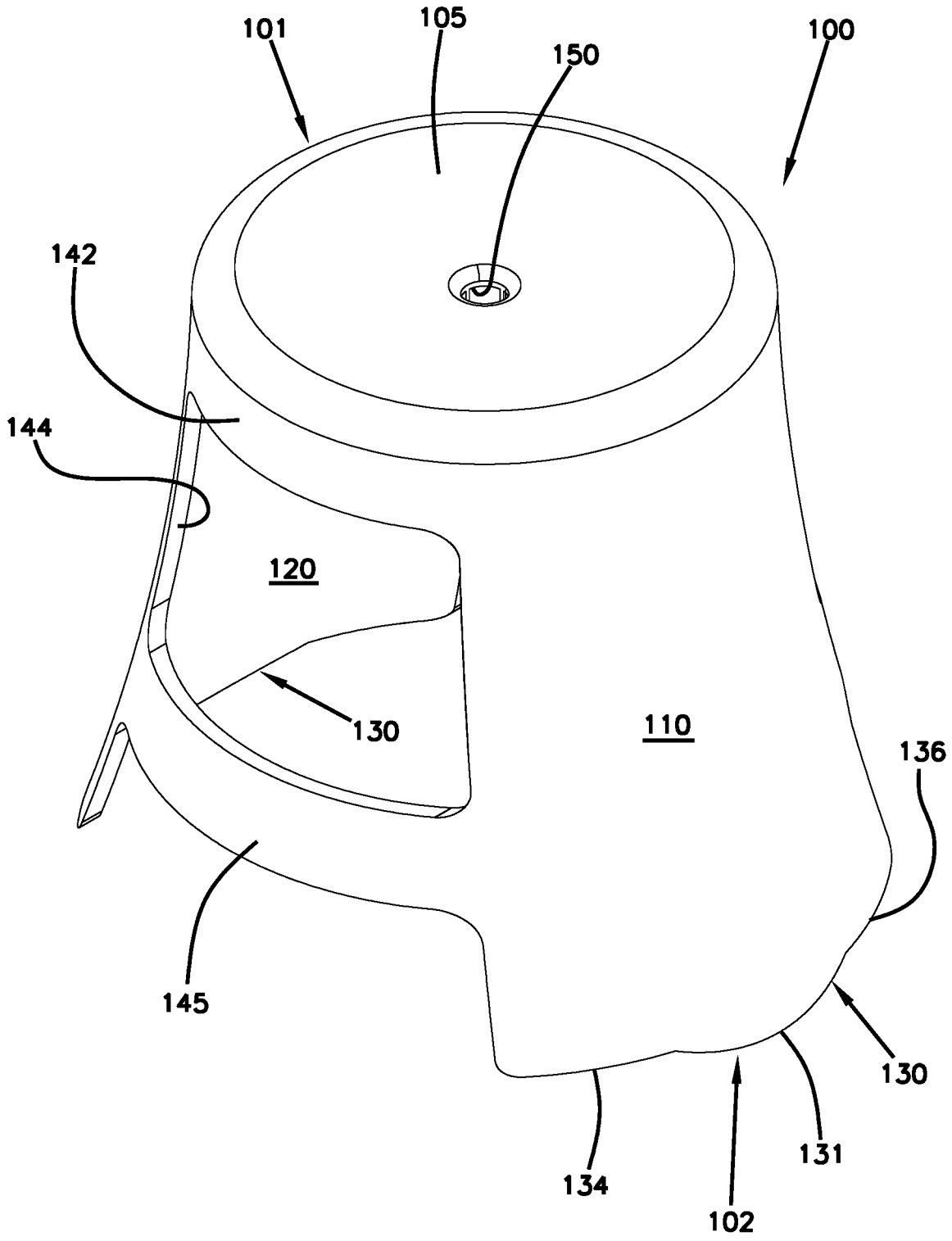
FIG. 1 is a top perspective view of an example stool configured in accordance with the principles of the present disclosure.

Aspects of the disclosure are directed to active seating. For convenience, the term "stool" is used herein to refer to various types of seating (e.g., backless seating, seating with back rests, seating with arms rests, etc.) and is not intended to be limiting. For example, a "stool" as used herein may optionally include a back rest and/or arms rest unless otherwise specified for a particular embodiment.

In accordance with some aspects of the disclosure, a stool includes a rocking surface allowing a user to sway from side to side while seated on the stool. It is noted that the term "side to side" can refer to a user's right and left, to the user's front and rear, or to other opposite directions relative to the user depending on the orientation of the user on the stool.

In accordance with certain aspects of the disclosure, the stool is stackable with other stools of the same type. In certain examples, the stools are stackable on a pole extending along an axis. In certain examples, the stools are stackable in any orientation along the axis.

Referring to the figures in general, a stool 100 includes a seat member 105, a first support member 110 extending downwardly from the seat member 105, and a second support member 120 extending downwardly from the seat member 105. The seat member 105 is shaped and sized to support a seated user. In some examples, the seat 105 is planar. In other examples, the seat 105 is contoured for comfort. In the example shown, the seat 105 is round. In other examples, the seat 105 can be square, rectangular, oblong, or any other desired shape.

The stool 100 defines a longitudinal axis AL extending between a top 101 and a bottom 102 of the stool 100. The stool 100 has an open bottom 102 leading to a generally hollow interior. In some examples, the seat member 105 defines the top 101 of the stool 100. In such examples, the stool 100 has a generally closed top and the open bottom 102. As the term is used herein, the seat member 105 is "generally closed" if the seat member 105 defines a hole 150 sized to receive a pole P (FIG. 11), defines perforations, or otherwise defines one or more openings as long as the seat member 105 is sufficiently closed to support a seated user. In other examples, the stool 100 can include a back rest or other structure that extends upwardly beyond the seat member 105 to define the top 101 of the stool 100.

The support members 110, 120 extend from opposite ends of the seat member 105 so that the support members 110, 120 face each other. Each support member 110, 120 defines a bottom surface 130 that allows for rocking movement of the stool 100. In some implementations, the bottom surface 130 includes a rocking surface 131 having a convex curvature. The stool 100, when resting on a floor F, can rock along the rocking surface 131, thereby causing the seat member 105 to sway (see FIGS. 4-6).

Figure 5:
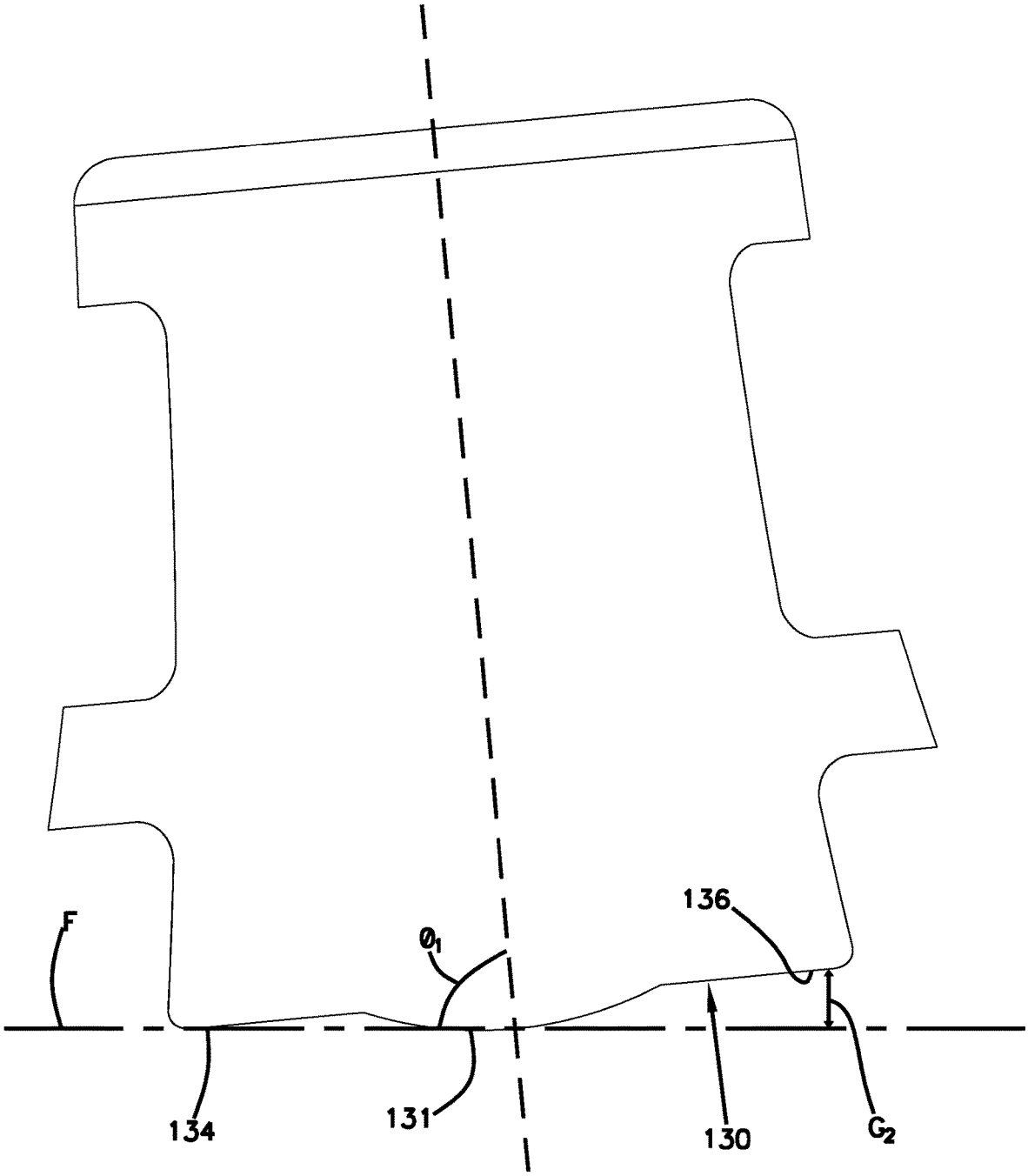
FIG. 5 is an end view of the stool of FIG. 1 showing the stool in a first inclined position along the rocking path.
Figure 6:
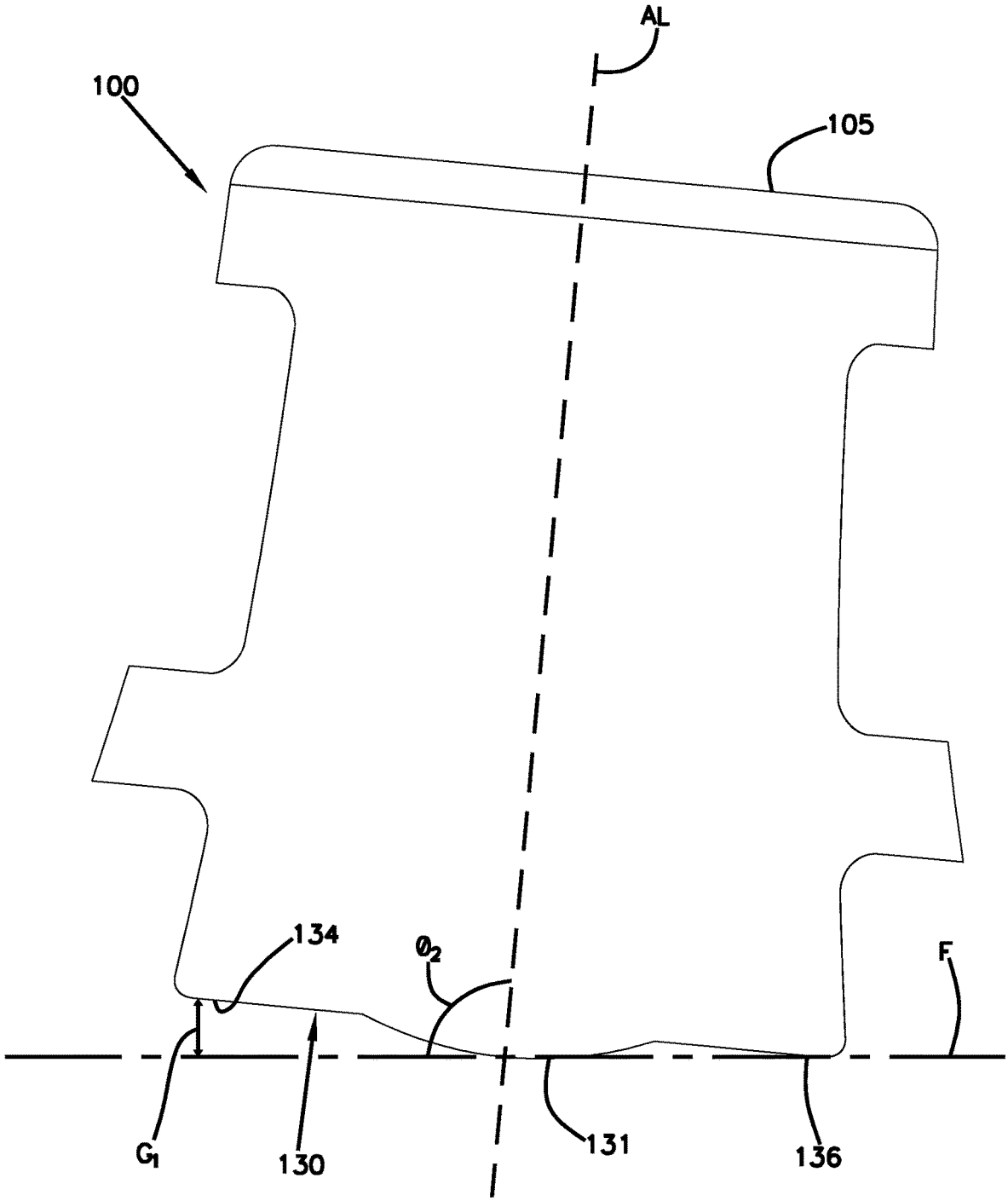
FIG. 6 is an end view of the stool of FIG. 1 showing the stool in a second inclined position along the rocking path.

In certain implementations, the stool 100 rocks along a path R (FIG. 4) between a first inclined position in which the longitudinal axis AL in oriented at an angle θ1 relative to the floor F (see FIG. 5) and a second inclined position in which the longitudinal axis AL in oriented at an angle θ2 relative to the floor F, where angle θ2 is larger than angle θ1 (see FIG. 6). In certain examples, the rocking surface 131 has a sufficiently gradual slope that the stool 100 can be balanced on the rocking surface 131 at a normal position so that the longitudinal axis AL is at least substantially perpendicular to the floor F (see FIG. 4).

In some implementations, the bottom surface 130 of the stool 100 also includes at least one rest surface 134, 136. The rest surface 134, 136 inhibits continued movement of the stool 100 in one direction. For example, the rest surface 134, 136 may touch the floor F while a portion of the rocking surface 131 remains connected to the floor F at a point along the path R. The rest surface 134, 136 cooperates with the rocking surface 131 to provide a stable position (e.g., the first inclined position and the second inclined position) at which the stool 100 may rest.

In certain implementations, the bottom surface 130 includes a first rest surface 134 extending outwardly from a first end 132 of the rocking surface 131 and a second rest surface 136 extending outwardly from a second end 133 of the rocking surface 131. In the example shown, the rest surfaces 134, 136 define planar surfaces that are parallel with the floor F when the stool 100 is disposed in the normal position (see FIG. 4). In other examples, the rest surfaces 134, 136 are shaped to contact the floor F as the stool 100 moves through certain points along the path R and to not contact the floor F as the stool 100 moves through other points along the path R.

Figure 4:
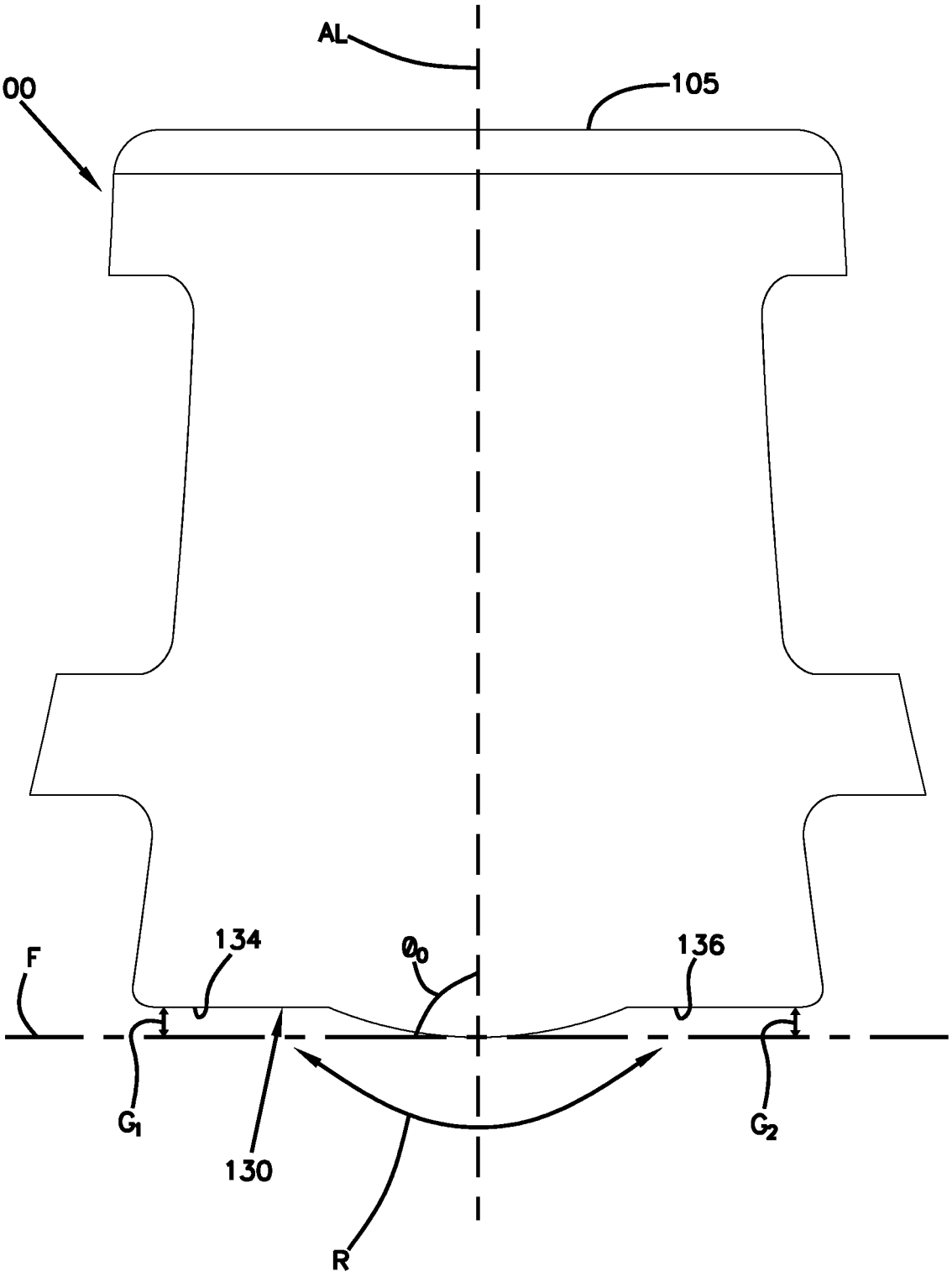
FIG. 4 is an end view of the stool of FIG. 1 showing a rocking path along which the stool can move.

In certain implementations, the first rest surface 134 and the second rest surface 136 are disposed above the floor F by a gap G1, G2, respectively, when the stool 100 is disposed in the normal position (FIG. 4). Moving the stool 100 in a first direction along the rocking path R to the first inclined position (FIG. 5) brings the first rest surface 134 into engagement with the floor F and increases the gap G2 between the second rest surface 136 and the floor F. The first rest surface 134 inhibits further movement of the stool 100 along the rocking path R in the first direction. Moving the stool 100 in an opposite second direction along the rocking path R to the second inclined position (FIG. 6) brings the second rest surface 136 into engagement with the floor F and increases the gap G1 between the first rest surface 134 and the floor F. The second rest surface 136 inhibits further movement of the stool 100 along the rocking path R in the second direction.

In some examples, each gap G1, G2 is no more than one inch large when the stool is disposed in the normal position. In certain examples, each gap G1, G2 is no more than three-quarters of an inch large when the stool is disposed in the normal position. In certain examples, each gap G1, G2 is no more than two-thirds of an inch large when the stool is disposed in the normal position. In certain examples, each gap G1, G2 is no more than half an inch large when the stool is disposed in the normal position. In certain examples, each gap G1, G2 is at least than a quarter-of-an-inch large when the stool is disposed in the normal position. In certain examples, each gap G1, G2 is at least a third of an inch large when the stool is disposed in the normal position. In certain examples, each gap G1, G2 is about half an inch large when the stool is disposed in the normal position.

Figure 3:
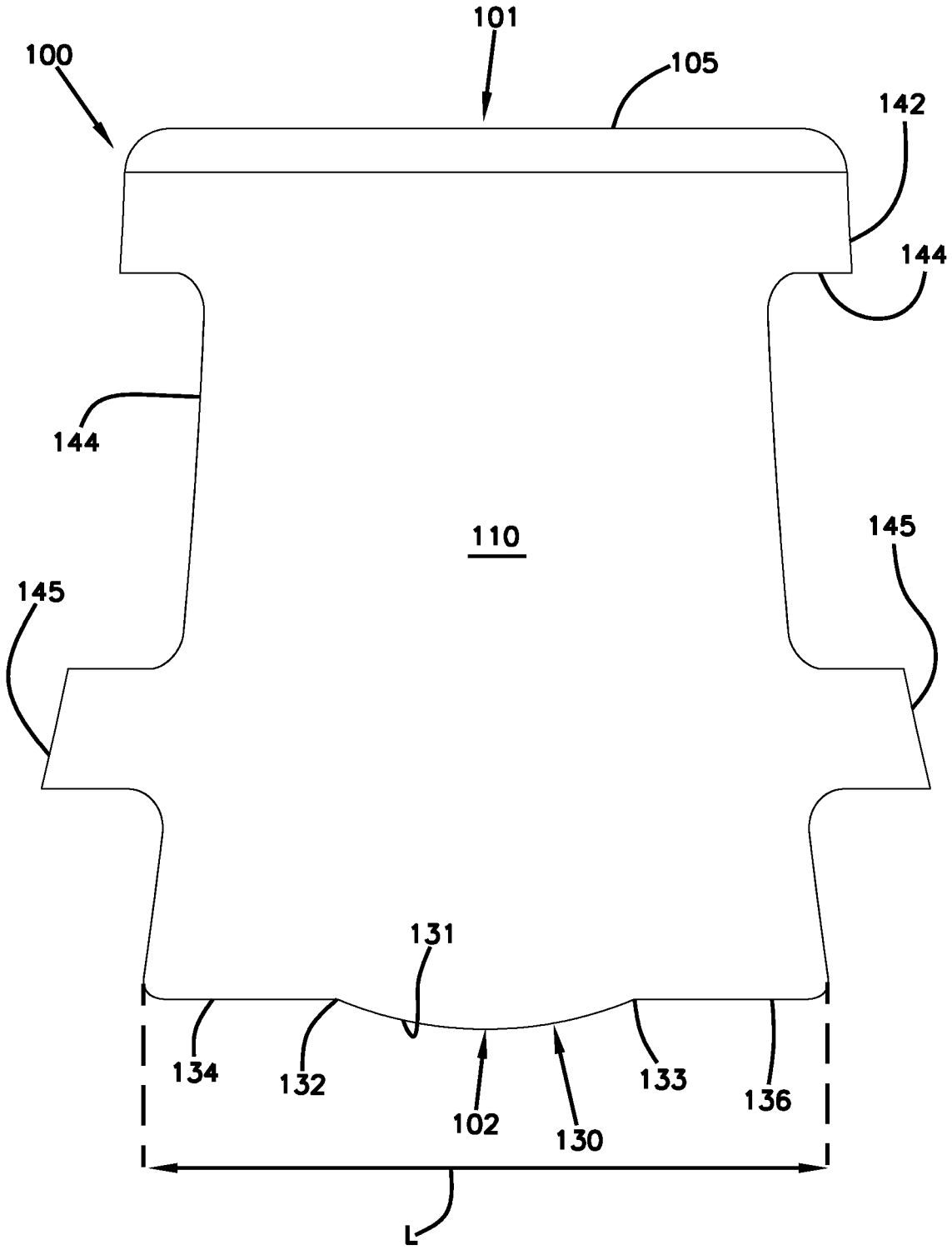
FIG. 3 is an end view of the stool of FIG. 1.

In some implementations, the rocking surface 131 defines about a third of a length L (FIG. 3) of the bottom surface 130. In certain example, the rocking surface 131 defines greater than a third of the length L of the bottom surface 130. In certain example, the rocking surface 131 defines no more than half of the length L of the bottom surface 130.

In certain implementations, feet or other gripping structures can be provided on the rest surfaces 134, 136. For example, rubber or other tacky materials can be disposed at the rest surfaces 134, 136 to aid a user in maintaining the stool 100 in one of the inclined positions. The feet or other gripping structures also can be formed of a damping material (e.g., rubber) that reduces the noise of the rest surfaces 134, 136 contacting the floor F.

In some implementations, the support members 110, 120 are connected by a rib 145. In certain examples, a first rib 145 connects the support members 110, 120 at a first side of the stool 100 and a second rib 145 connects the support members 110, 120 at a second side of the stool 100. In certain examples, each rib 145 is sufficient strong to support the feet of a user while the user sits on the seat member 105.

Figure 2:
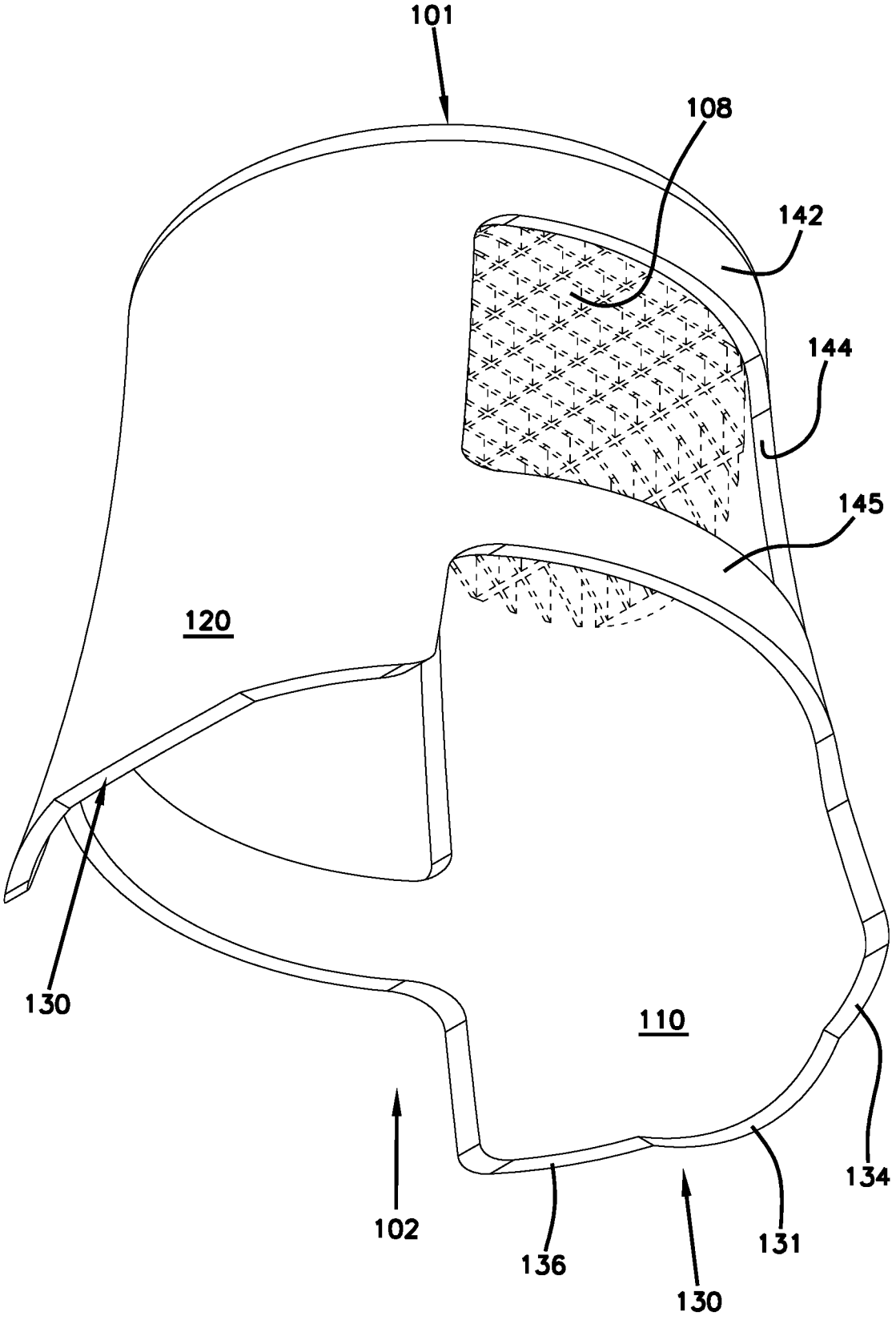
FIG. 2 is a bottom perspective view of the stool of FIG. 1.

In certain implementations, an annular ring 142 extends downwardly from the seat member 105. The annular ring 142 forms part of each support member 110, 120 (see FIGS. 1 and 2). An aperture 144 is defined between each rib 145, a corresponding portion of the annular ring 142, the first support member 110, and the second support member 120. The annular ring 142 and aperture 144 are sufficiently large to enable a user to grab the stool 110 by the annular ring 142 (e.g., by grasping a bottom edge of the annular ring 142).

In certain implementations, structural ribs 108 are disposed beneath the seat member 105 to enhance the strength of the seat member 105 and/or to enhance the connection between the seat member 105 and the support members 110, 120. In certain examples, the stool 100 is monolithically formed (e.g., via injection molding).

Figure 7:
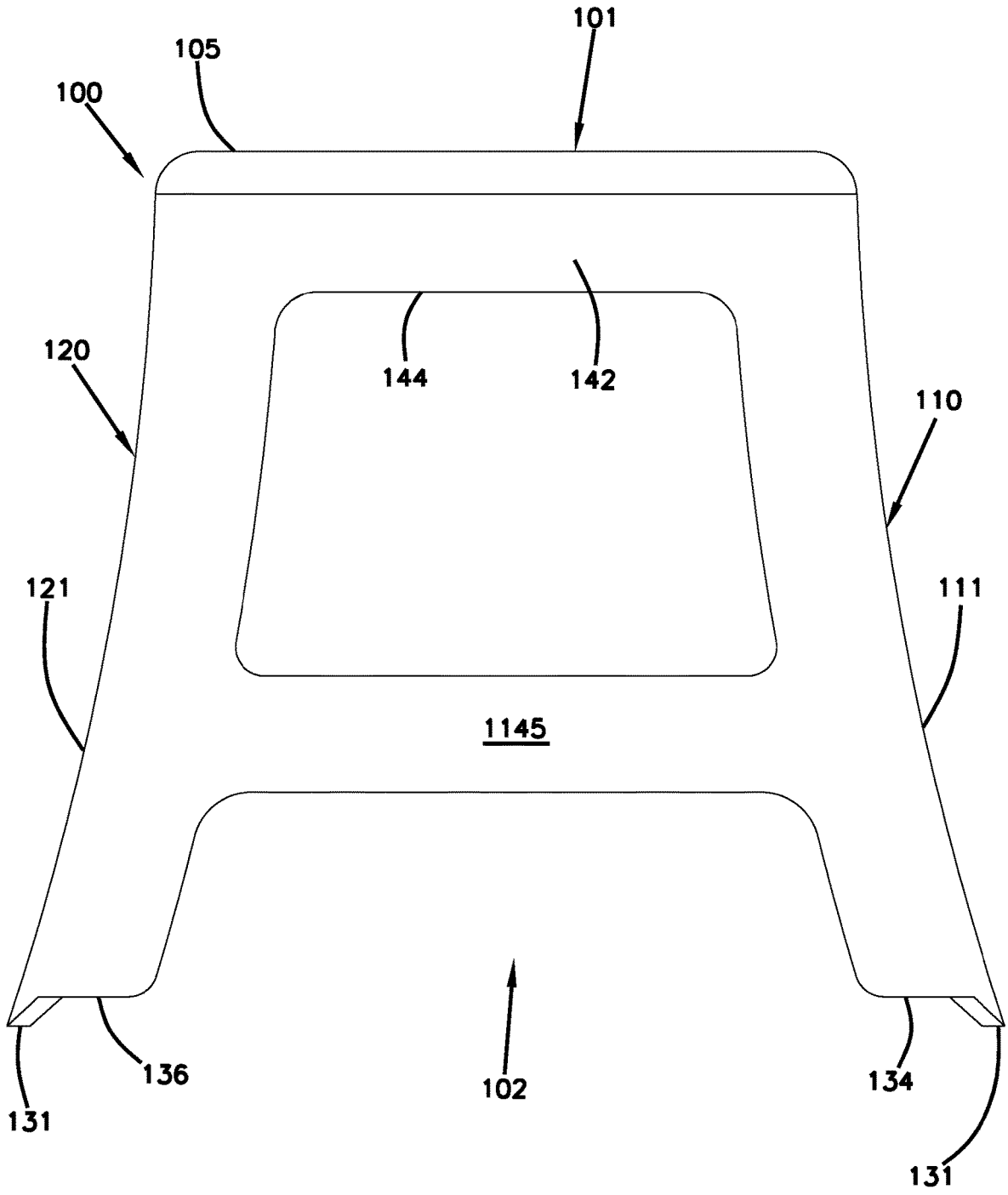
FIG. 7 is a side view of the stool of FIG. 1.
Figure 8:
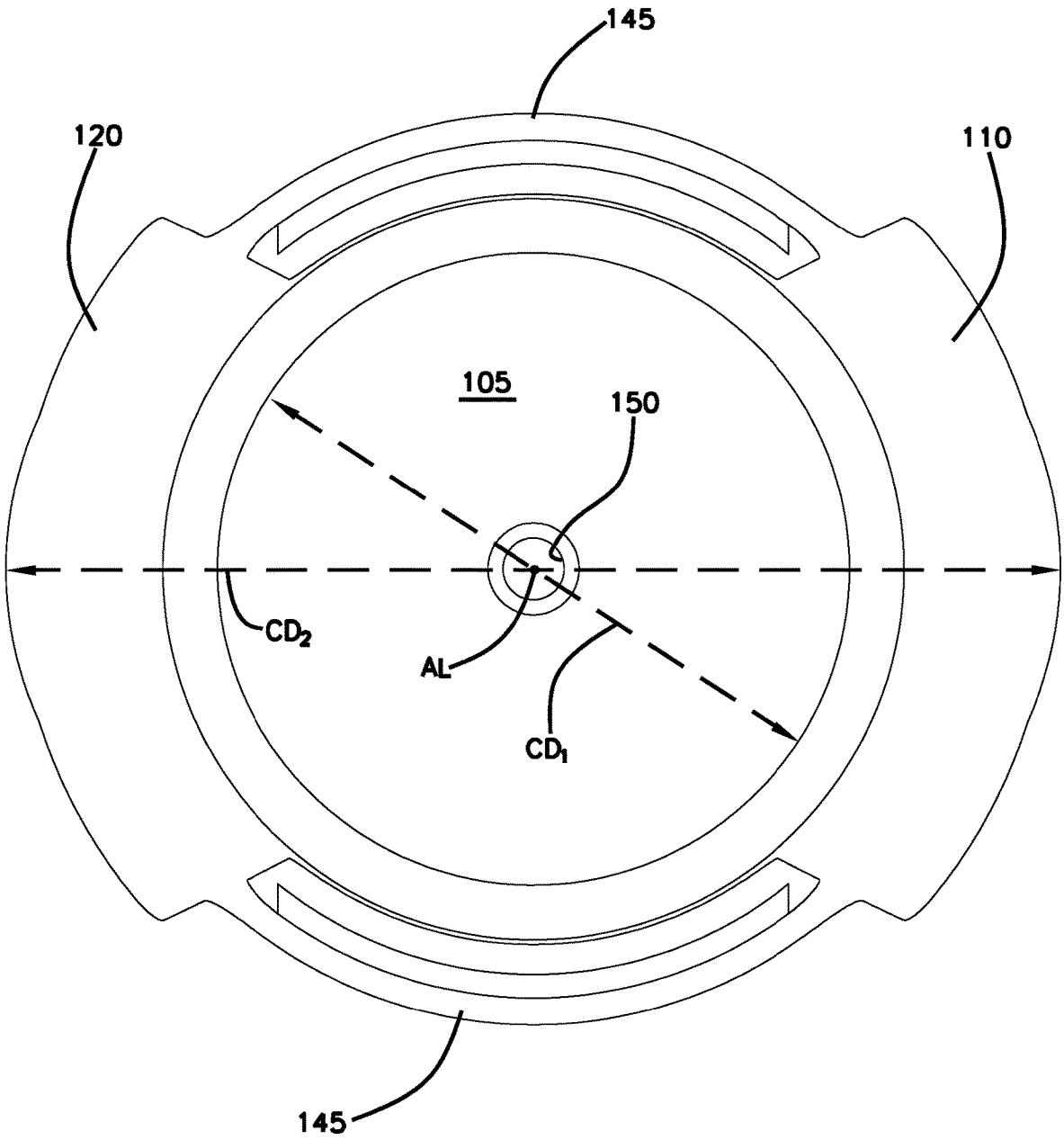
FIG. 8 is a top plan view of the stool of FIG. 1.
Figure 9:
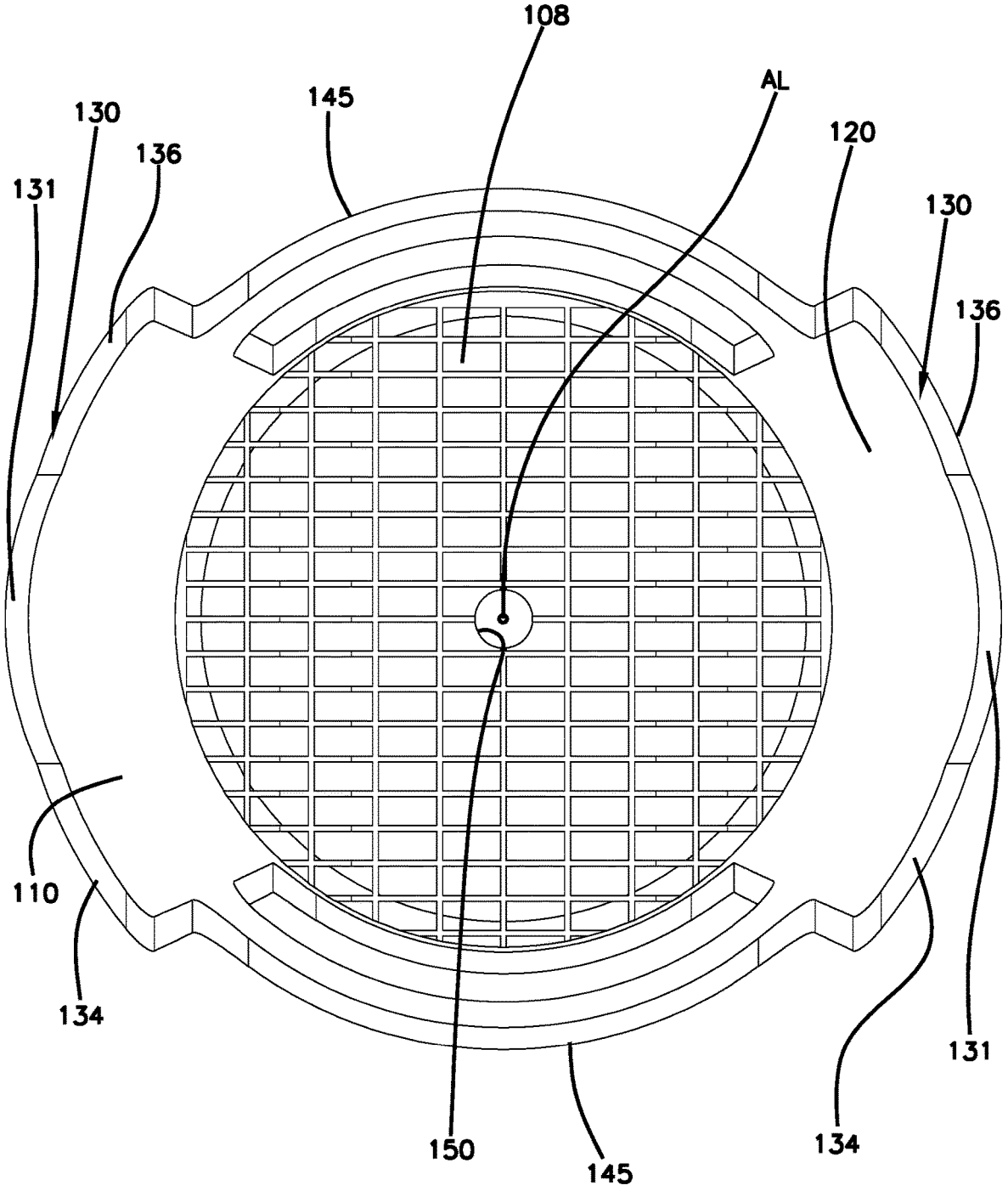
FIG. 9 is a bottom plan view of the stool of FIG. 1.

Referring to FIGS. 7-9, the support members 110, 120 extend radially outwardly from the seat member 105 as the support members 110, 120 extend downwardly from the seat member 105. For example, the stool 100 has a first cross-dimension (e.g., diameter) CD1 at the seat member 105 and the stool 100 has a second cross-dimension CD2 at the bottom of the support members 110, 120. The second cross-dimension CD2 is larger than the first cross-dimension CD1. In some examples, each support member 110, 120 has a concavely-curved exterior surface 111, 121, respectively, (see FIG. 7) that extends between the seat member 105 and the respective bottom surface 130. In other examples, each support member 110, 120 has an inclined exterior surface 111, 121.

In certain implementations, the support members 110, 120 also defines a circumferential curvature about the longitudinal axis AL (see FIGS. 8 and 9). In certain examples, the tops of the support members 110, 120 extend along part of the periphery of the seat member 105. In certain examples, the bottom surface 130 of each support member 110, 120 also curve along the longitudinal axis AL.

Figure 10:
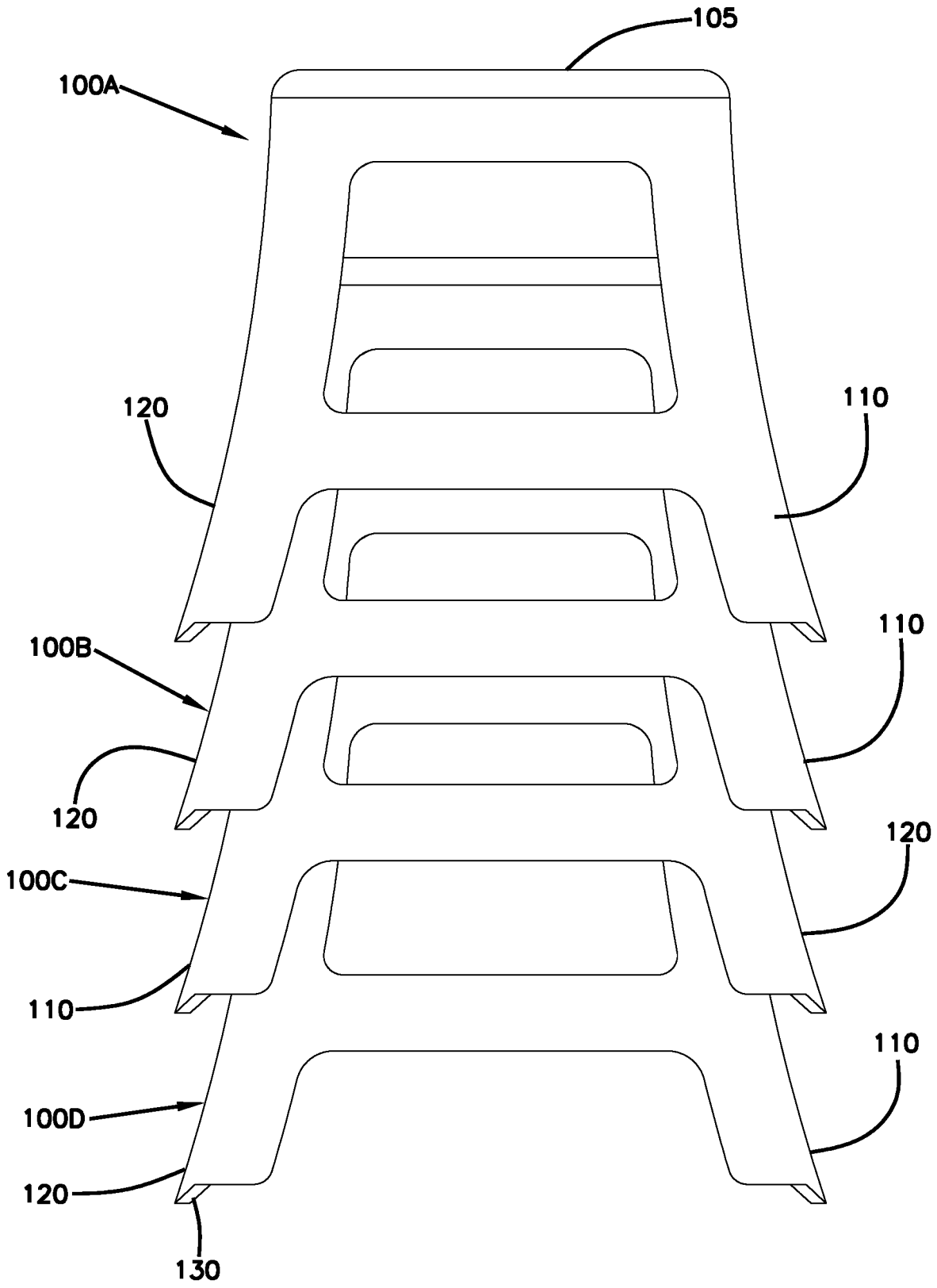
FIG. 10 is an end view of a stack of stools of the same type as the stool of FIG. 1.
Figure 11:
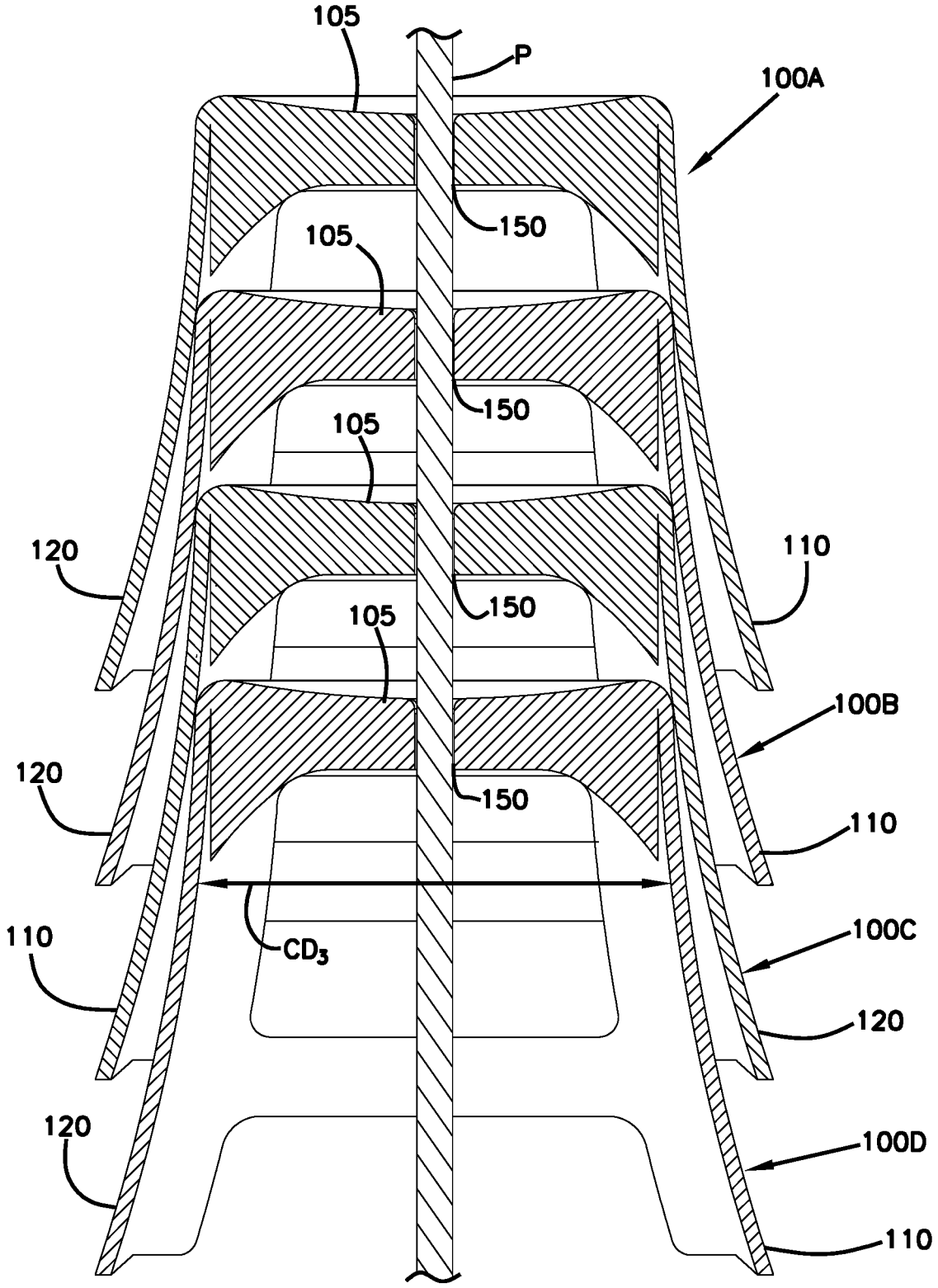
FIG. 11 is a cross-section of the stack of FIG. 10.

Referring to FIGS. 10 and 11, multiple stools 100 can be stacked together. For example, in FIG. 10, a first stool 100A is shown stacked over a second stool 100B, which is stacked over a third stool 100C, which is stacked over a fourth stool 100D. The seats 105 of the second, third, and fourth stools 100B, 100C, 100D are nested into the hollow interiors of the adjacent stools 100A, 100B, 100C, respectively.

In certain examples, each stool 100 has an interior cross-dimension CD3 (FIG. 11) that is sufficiently large to receive the seat 105 of another stool 100 of the same type. In certain examples, the interior cross-dimension CD3 is located above the ribs 145. In certain examples, the seat 105 extends at least one-third of the way into the hollow interior of the next stool 100 in the stack. In certain examples, the seat 105 extends at least half-way into the hollow interior of the next stool 100 in the stack. In certain examples, the seat 105 extends at least two-third of the way into the hollow interior of the next stool 100 in the stack.

In certain implementations, the stool 100 is sufficiently symmetrical that the stool 100 can be rotated 180° about the longitudinal axis AL compared to other stools 100 in a stack. For example, in FIG. 10, the third stool 100C is rotated 180° compared to the other stools 100. In certain examples, the stool 100 is sufficiently symmetrical that the stool 100 can be rotated 90° about the longitudinal axis AL compared to the other stools 100 in the stack. For example, portions of the support members 110, 120 of a lower stool 100 can fit between the ribs 145 of an upper stool 100 to allow stacking.

In certain implementations, each stool 100 defines a hole 150 to enable stacking of the stools 100 on a pole P (see FIG. 11). In certain examples, the hole 150 is a central hole located along the longitudinal axis AL. The pole P extends through the central aperture 150. Stacking the stools 100 on the pole P can aid in quickly aligning the stools 100 relative to each other for easy stacking. In certain examples, the stools 100 are shaped and dimensioned so that the stools 100 can be stacked in any rotational orientation about the longitudinal axis. For example, the support members 110, 120 of a first stool can extend over apertures 144 of a second stool 110.

In certain implementations, the apertures 144 facilitate use of the stools 100 by inhibiting suction between stacked stools 100. As shown in FIG. 10, a lower stool 100B extends sufficiently far into an upper stool 100A that the apertures 144 of the lower stool 100B at least partially overlap in a longitudinal direction with the apertures 144 of the upper stool 100A. The overlapping apertures 144 inhibit the creation of suction between the stools 100A, 100B. In some examples, the upper and lower stools 100A, 100B are oriented so that the apertures 144 of the upper stool 100A radially align with apertures 144 of the lower stool 100B. In other examples, the upper stool 100A is rotated about 90° about the longitudinal axis AL relative to the lower stool 100B. In other examples, the upper stool 100A can be in any rotational orientation about the longitudinal axis AL relative to the lower stool 100B.

Figure 12:
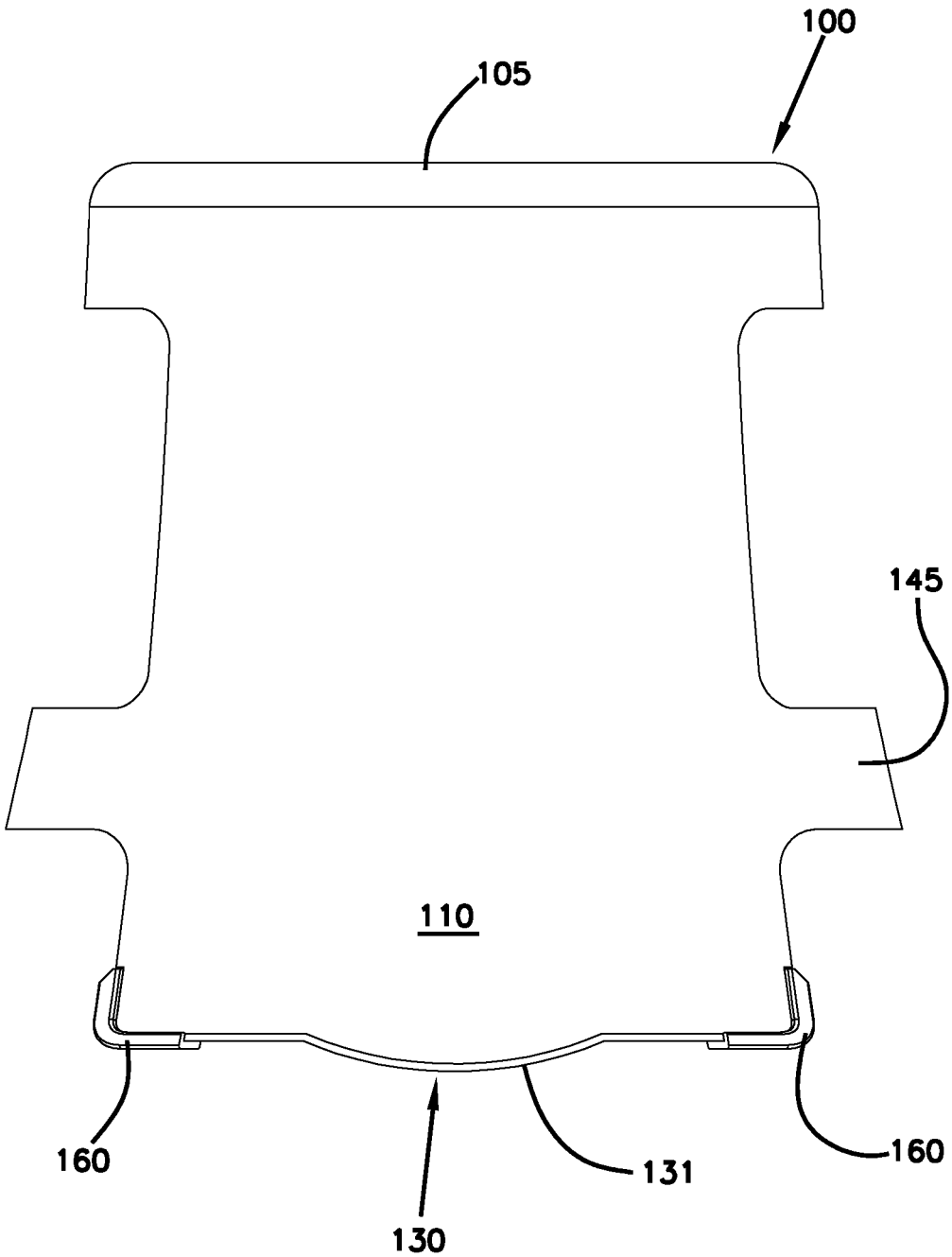
FIG. 12 is an end view of the stool of FIG. 1 with feet mounted at the bottom surface of the support member.
Figure 13:
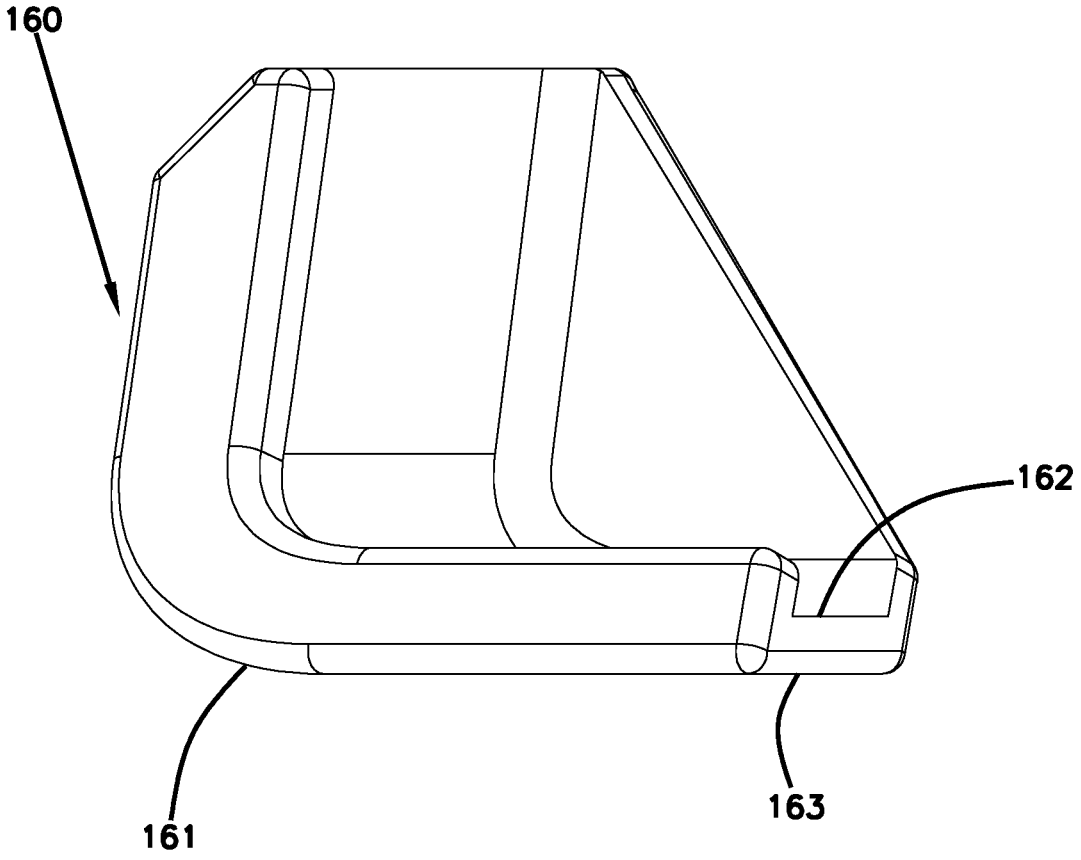
FIG. 13 is a perspective view of an example foot of FIG. 12.

Referring to FIGS. 12 and 13, a stabilizing or noise dampening material may be applied to the bottom surfaces 130 of the support members 110, 120. For example, feet 160 may be applied to the rest surfaces 134, 136 of the bottom surfaces 130. Some example feet 160 are formed from rubber or other material having a higher friction coefficient than the material forming the support members 110, 120. Other example feet 160 are formed from other elastomeric material. In some examples, the feet 160 are disposed at outer corners of the rest surfaces 134, 136 of the support members 110, 120 (see FIG. 12). In other examples, the feet 160 define an entirety of the rest surfaces 134, 136.

FIG. 13 illustrates an example foot 160 suitable for use with the stool 100. The foot 160 includes a body 161 defining an inner channel 162 sized and shaped to receive an edge of one of the support members 110, 120. The foot body 161 also defines an exterior surface 163 oriented to selectively contact the floor F depending on the position of the stool 100 relative to the floor F. For example, the feet 160 mounted at the first rest surfaces 134 contact the floor F when the stool 100 is disposed in the first inclined position and the feet 160 mounted at the second rest surfaces 136 contact the floor F when the stool 100 is disposed in the second inclined position.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A stool having a longitudinal axis extending between a top and bottom of the stool, the stool comprising:

a seat member;

a first support member extending downwardly from the seat member to the bottom of the stool;

a second support member extending downwardly from the seat member to the bottom of the stool, the second support member being disposed at an opposite end of the seat member from the first support member; and each support member having a downwardly-facing surface defining a convexly-curved rocking surface, a first rest surface extending outwardly from a first side of the rocking surface, and a second rest surface extending outwardly from an opposite second side of the rocking surface, each rocking surface defining no more than half of a length of the respective bottom surface.

2. The stool of claim 1, wherein the seat member has a first cross-dimension; and wherein the first and second support members define an open bottom that has a second cross-dimension that is larger than the first cross-dimension.

3. The stool of claim 1, wherein a rib extends laterally between the first and second support members, the rib cooperating with the seat member and the support members to define an aperture.

4. The stool of claim 3, wherein the rib is a first rib; and wherein a second rib extends laterally between the first and second support members at an opposite side of the stool from the first rib.

5. The stool of claim 1, wherein an aperture is defined beneath the seat member and between the first and second support members, the aperture being sized to enable fingers of the user to wrap around the seat member to grasp the stool.

6. The stool of claim 1, wherein each rest surface connects to the rocking surface at an obtuse angle.

7. The stool of claim 1, wherein each support member extends radially outwardly from the seat as the support member extends downwardly to the bottom.

8. The stool of claim 7, wherein each support member has an outwardly-facing surface and an inwardly-facing surface, wherein the outwardly-facing surface has a concave curvature extending between the top and the bottom.

9. The stool of claim 7, wherein the support members have a thickness; and wherein each support member extends radially outwardly from the seat member by a distance that is greater than the thickness of the support members.

10. The stool of claim 1, wherein the seat member defines a central aperture extending between a top of the seat member and a bottom of the seat member.

11. The stool of claim 1, wherein the stool is a first stool; and wherein a second stool is stacked over the first stool.

12. The stool of claim 11, wherein the second stool is identical to the first stool.

13. A active seating system comprising:

a plurality of stools, each stool extending along a longitudinal axis between a closed top and an open bottom, the closed top of each stool having a first cross-dimension and the open bottom of each stool having a second cross-dimension that is larger than the first cross-dimension, each stool having a sufficiently hollow interior accessible through the open bottom to allow a first of the stools to be stacked over a second of the stools so that the top of the second stool extends into the hollow interior of the first stool through the bottom of the first stool, each of the stools defining a rocking surface at the respective open bottom, the stools being sufficiently symmetrical that the first stool can be rotated 90 degrees along the longitudinal axis compared to the second stool when stacked over the second stool.

14. The active seating system of claim 13, further comprising a pole at which the stools are stacked, the pole extending through a central longitudinal aperture defined in each stool.

15. The active seating system of claim 13, wherein each stool includes a rest surface configured to cooperate with the rocking surface to hold the stool at an inclined position.

16. The active seating system of claim 15, wherein the inclined position is a first inclined position, and wherein each stool includes a second rest surface configured to cooperate with the rocking surface to hold the stool at a second inclined position that is angled in an opposite direction from the first inclined position.

17. The active seating system of claim 13, wherein the rocking surface is a first rocking surface defined by a first support member; wherein a second support member defines a second rocking surface, the first and second support members defining the open bottom of the stool.

18. The active seating system of claim 17, wherein each stool defines apertures between the support members to inhibit suction between the stools while the stools are being pulled apart.

19. A method of sitting on a seat comprising:

sitting on a seat member of a stool that is supported off a floor by support members;

balancing on rocking surfaces defined by the support members;

swaying in a first direction until a first rest surface of each support member contacts the floor while the rocking surface also contacts the floor, wherein the first rest surface inhibits continued movement of the rocking surface in the first direction; and swaying in an opposite second direction until a second rest surface of each support member contacts the floor while the rocking surface also contacts the floor, wherein the second rest surface inhibits continued movement of the rocking surface in the second direction, the rocking surface of each support member defining no more than half of a length of a respective bottom surface of the support member.

20. The method of claim 19, wherein the stool is first stool, and wherein the method further comprises:

removing the first stool from a stack of stools of the same type by lifting the first stool off of a seat member of a second of the stools in the stack so that the seat member of the second stool is no longer within a hollow interior of the first stool.

* * * * *